US008734298B2

(12) United States Patent
Murray

(10) Patent No.: US 8,734,298 B2
(45) Date of Patent: May 27, 2014

(54) ADJUSTABLE EXERCISE MACHINE

(75) Inventor: Brian Murray, Shalu (TW)

(73) Assignee: Dyaco International, Inc., Taipei (TW)

( * ) Notice: Subject to any disclaimer, the term of this patent is extended or adjusted under 35 U.S.C. 154(b) by 599 days.

(21) Appl. No.: 13/012,455

(22) Filed: Jan. 24, 2011

(65) Prior Publication Data

US 2012/0190507 A1 Jul. 26, 2012

(51) Int. Cl.
*A63B 22/04* (2006.01)
*A63B 22/02* (2006.01)

(52) U.S. Cl.
USPC ..... 482/52; 482/51; 482/57

(58) Field of Classification Search
USPC ..... 482/51–54, 57, 62, 79–80
See application file for complete search history.

(56) References Cited

U.S. PATENT DOCUMENTS 6,273,843 B1 8/2001 Lo
6,682,460 B2 1/2004 Lo et al.
7,060,005 B2 6/2006 Carlsen et al.
7,104,929 B1 9/2006 Eschenbach
7,153,239 B1 12/2006 Stearns et al.
7,244,218 B1 7/2007 Lin et al.
7,361,122 B2 4/2008 Porth
7,618,350 B2 * 11/2009 Dalebout et al. ..... 482/52
D606,599 S 12/2009 Murray et al.
7,654,936 B2 2/2010 Liao et al.
7,682,290 B2 3/2010 Liao et al.
7,691,035 B2 4/2010 Chen et al.
7,722,505 B2 * 5/2010 Liao et al. ..... 482/52
7,846,071 B2 12/2010 Fenster et al.

FOREIGN PATENT DOCUMENTS

WO WO-2007055937 A1 5/2007
WO WO-2007056136 A1 5/2007

* cited by examiner

*Primary Examiner* — Stephen Crow
(74) *Attorney, Agent, or Firm* — Perkins Coie LLP; Stephen E. Arnett

(57) ABSTRACT

Stationary exercise machines having adjustable incline systems are disclosed herein. In one embodiment, for example, an elliptical exercise machine includes a system for adjusting the inclination of foot support guide tracks. The incline adjustment system can include a lift member that operates between the guide tracks and the floor on which the exercise machine is placed.

12 Claims, 7 Drawing Sheets

ADJUSTABLE EXERCISE MACHINE

TECHNICAL FIELD

The following disclosure relates generally to exercise machines and, more particularly, to elliptical exercise machines in which the inclination of the pedal path or stroke can be adjusted.

BACKGROUND

There are a wide variety of stationary exercise machines available today for those wishing to engage in cardiovascular exercise without the impact on their knees and other joints often caused by running. Conventional elliptical exercise machines, for example, typically include a pair of foot pedals connected to a wheel or other rotating member by a pair of arms. Each arm includes a front end that is pivotally attached to an outer portion of the wheel and an aft end that is movably supported in or on a guide track. As the user exerts an alternating downward force against the foot pedals, the front ends of the arms drive the wheel in circular motion while the aft ends of the arms reciprocate back and forth on their respective tracks. Many elliptical exercise machines include handles for the user to grip during their workout. Some handles are pivotally linked to the foot pedals to provide a coordinated, running-like movement for the arms and legs.

Conventional elliptical exercise machines derive their name from the general path described by the foot pedals throughout their stroke. It is often desirable for a particular user to adjust the path or stroke of the foot pedals to suit his or her frame or to provide a more or less rigorous workout regime. One way to alter the foot path is to change the inclination of the foot support tracks, and many elliptical exercise machines include manual or powered systems for accomplishing this. Some of these systems, however, may have certain shortcomings. Accordingly, it would be advantageous to provide an improved system for easily adjusting the foot path or stroke on elliptical exercise machines.

DETAILED DESCRIPTION

The present disclosure describes various embodiments of elliptical exercise machines and other stationary exercise machines having incline adjustment systems. In one embodiment, for example, an elliptical exercise machine configured in accordance with the present disclosure includes a system that increases the inclination of foot support tracks by pressing against the floor beneath the machine. Certain details are set forth in the following description and in FIGS. 1A-4B to provide a thorough understanding of various embodiments of the disclosure. Other details describing well-known structures and systems often associated with elliptical exercise machines and other exercise equipment and systems have not been set forth in the following disclosure to avoid unnecessarily obscuring the description of the various embodiments of the disclosure.

Many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar, elements. To facilitate the discussion of any particular element, the most significant digit or digits of any reference number refers to the Figure in which that element is first introduced. For example, element 110 is first introduced and discussed with reference to FIG. 1.

Figure 1A:
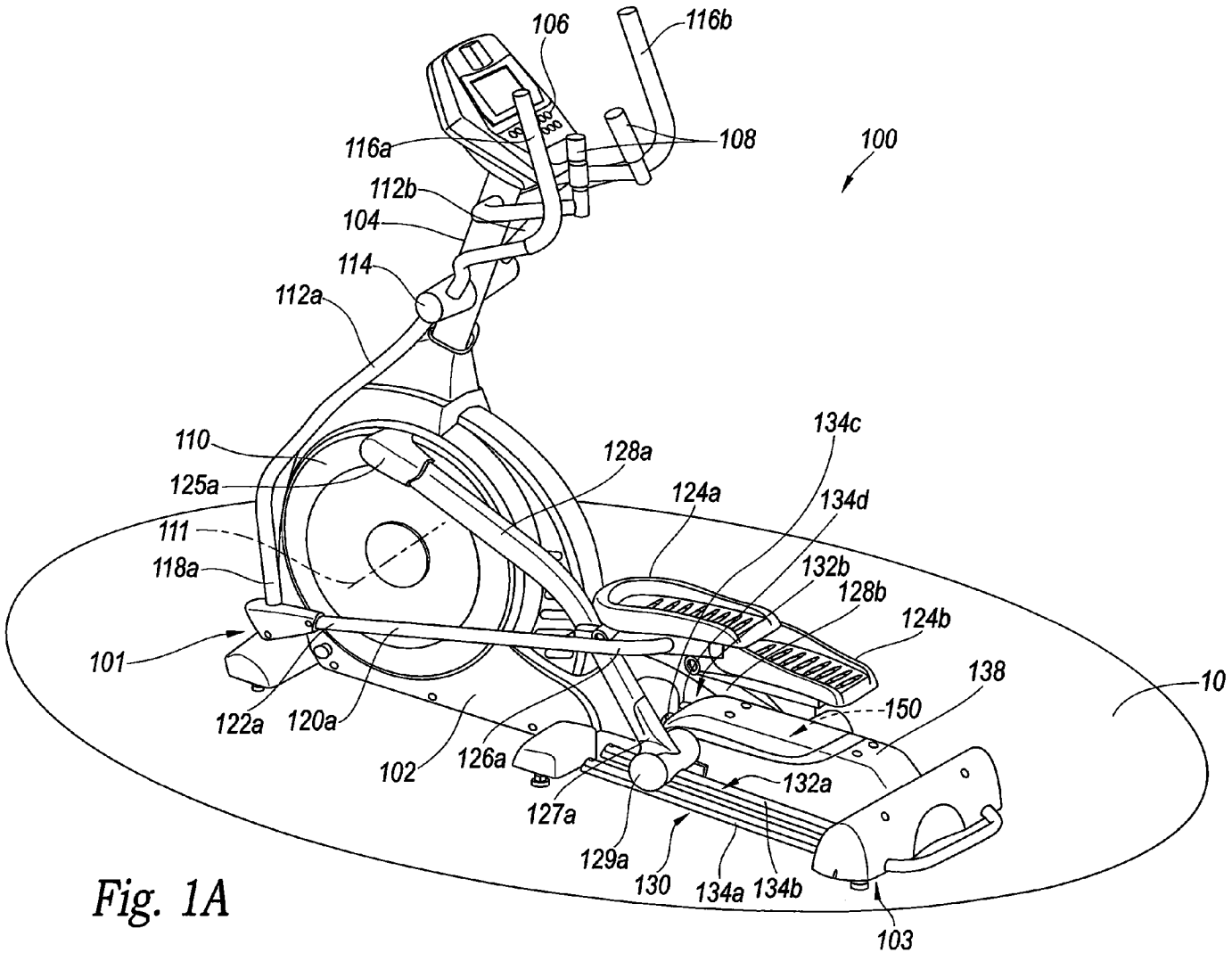
FIGS. 1A and 1B are isometric views of a stationary exercise machine having an incline adjustment system configured in accordance with an embodiment of the disclosure.
Figure 1B:
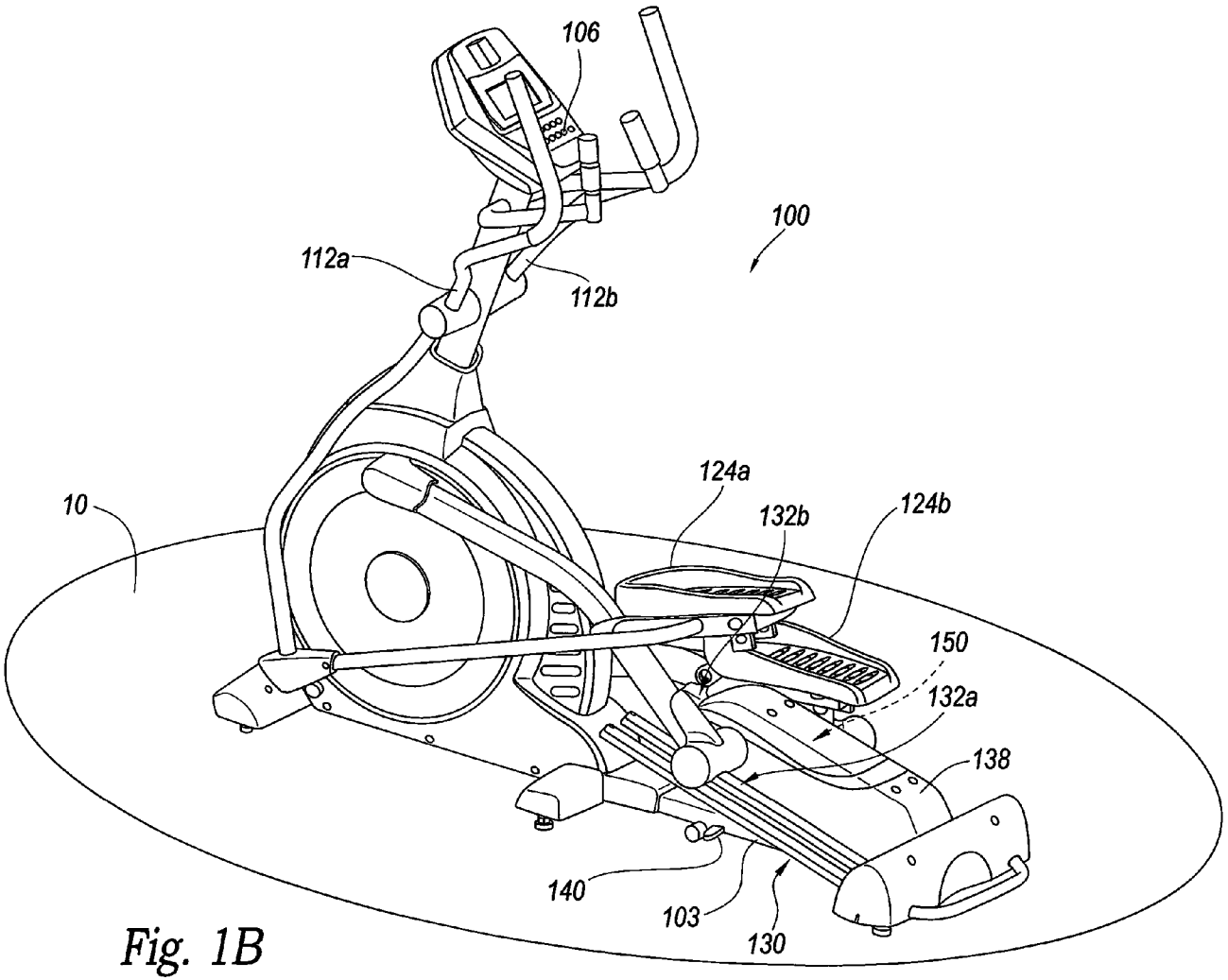

FIGS. 1A and 1B are rear isometric views of an elliptical exercise machine 100 ("exercise machine 100") having an incline adjustment system 150 configured in accordance with the embodiment of the disclosure. Referring to FIGS. 1A and 1B together, the exercise machine 100 includes a base structure 102 positioned on a floor 10 in an exercise facility or other location. The base structure 102 includes a forward or front portion 101 and an aft or rear portion 103. A track frame 130 is pivotally coupled to, or at least proximate to the rear portion 103 of the base structure 102. The track frame 130 includes a first guide track 132*a* positioned toward one side of the exercise machine 100 and a second guide track 132*b* positioned toward the other side of the exercise machine 100. In the illustrated embodiment, each of the guide tracks 132 includes a pair of parallel guides or rods 134 (identified individually as rods 134*a*-134*d*).

In the illustrated embodiment, the incline adjustment system 150 is positioned under a cover 138, and can be employed to automatically raise and lower the guide tracks 132. In FIG. 1A, the guide tracks 132 are illustrated in a lower or first position, and in FIG. 1B the guide tracks 132 are illustrated in an inclined or second position. As shown in FIG. 1B, the rear portion 103 of the base structure 102 can include one or more track supports 140 and/or other suitable features to support the guide tracks 132 when they are in the lower position illustrated in FIG. 1A.

A column 104 extends upwardly from the front portion 101 of the base structure 102 and supports a control panel 106. As described in greater detail below, the control panel 106 can include one or more switches, dials, knobs, touch screens, and/or other user input devices that allow the user (not shown) to adjust operating parameters of the exercise machine 100, view operating information, etc. A first handle 112*a* and a corresponding second handle 112*b* are pivotally mounted on opposite sides of the column 104 by means of a suitable axle 114. Each of the handles 112 includes an upper end portion 116 (identified individually as a first upper end portion 116*a* and a second upper end portion 116*b*) which can serve as a hand grip. The exercise machine 100 can additionally include a pair of stationary hand grips 108 positioned toward an upper portion of the column 104. Each of the handles 112 additionally includes a lower end portion 118 pivotally coupled to a forward or front end portion 122 of a corresponding foot support link 120. Although only a first lower end portion 118*a* and a first foot support link 120*a* are shown in FIGS. 1A and 1B, those of ordinary skill in the art will appreciate that a corresponding second lower end portion and a corresponding second foot support link are similarly positioned on the opposite side of the exercise machine 100. Each foot support link 120 includes an aft or rear end portion 126 coupled to a corresponding foot pedal 124 (identified individually as a first foot pedal 124*a* and a second foot pedal 124*b*).

A forward portion of each of the foot pedals 124 is pivotally attached to a corresponding arm 128 (identified individually as a first arm 128*a* and a second arm 128*b*). Each of the arms 128 includes a front end portion 125 and a rear end portion 127. In the illustrated embodiment, the front end portions 125 are pivotally coupled to opposite sides of a rotating member or wheel 110 in diametrically opposite positions. The wheel 110 is rotatably supported by the base structure 102 on a central axis 111. The rear end portion 127 of each arm 128 can include one or more rollers (not shown in FIGS. 1A and 1B) positioned under a corresponding cover 129. The rollers can be configured to movably support the rear end portions 127 as they move back and forth on the rods 134 which form the guide tracks 132. Many components and features of the exercise machine 100 can be at least generally similar in structure and function to corresponding components and features of the exercise machine or machines disclosed in U.S. Pat. No. 7,691,035, which is incorporated herein in its entirety by reference.

To operate the exercise machine 100, the user steps onto the pedals 124 and grasps the hand grips 116 (alternatively, the user can grasp the auxiliary hand grips 108). The user then begins driving the foot pedals 124 downwardly in an alternating manner while moving the hand grips 116 back and forth in a simulated running motion. As the user does this, the downward motion of the foot pedals 124 drives the wheel 110 in forward rotation by means of the arms 128. As the forward end portions 125 of the arms 128 revolve around the central axis 111, the rear end portions 127 reciprocate back and forth on the corresponding guide tracks 132. As a result, the foot pedals 124 describe a path or stroke that can generally be described as an ellipse. In FIG. 1A, the guide tracks 132 are in a flat or generally horizontal position, thereby providing an elliptical path that is generally horizontal. If the user wishes to increase the incline of the elliptical foot path or stroke as illustrated in FIG. 1B, the user can raise the guide tracks 132 a desired amount by operating the corresponding input device (e.g., button, touch screen, etc.) on the control panel 106. As described in greater detail below, the input device on the control panel 106 is operably connected to the incline adjustment system 150.

Figure 2A:
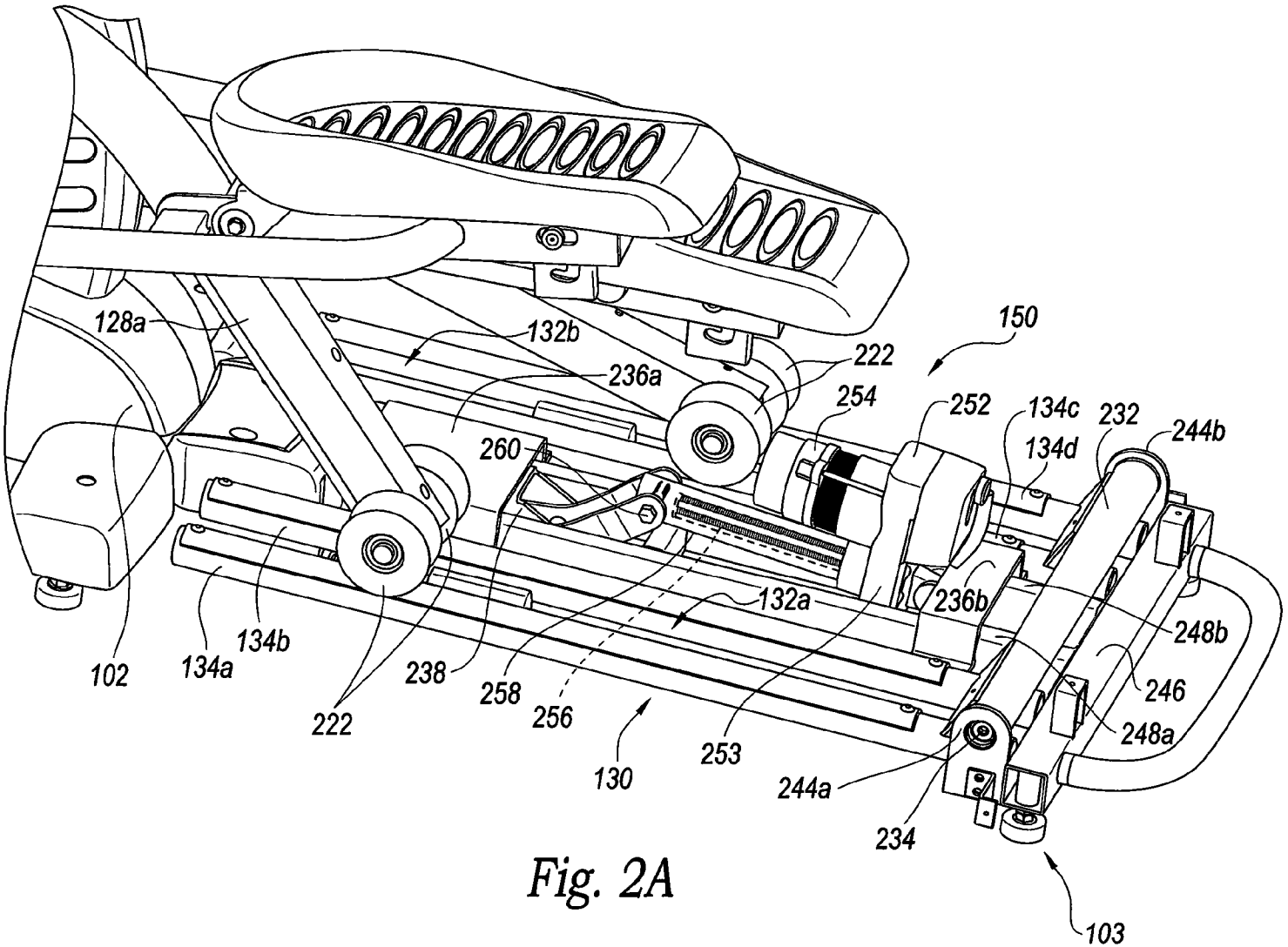
FIG. 2A is an enlarged isometric view of the incline adjustment system of FIGS. 1A and 1B with selected components removed for purposes of clarity.
Figure 2B:
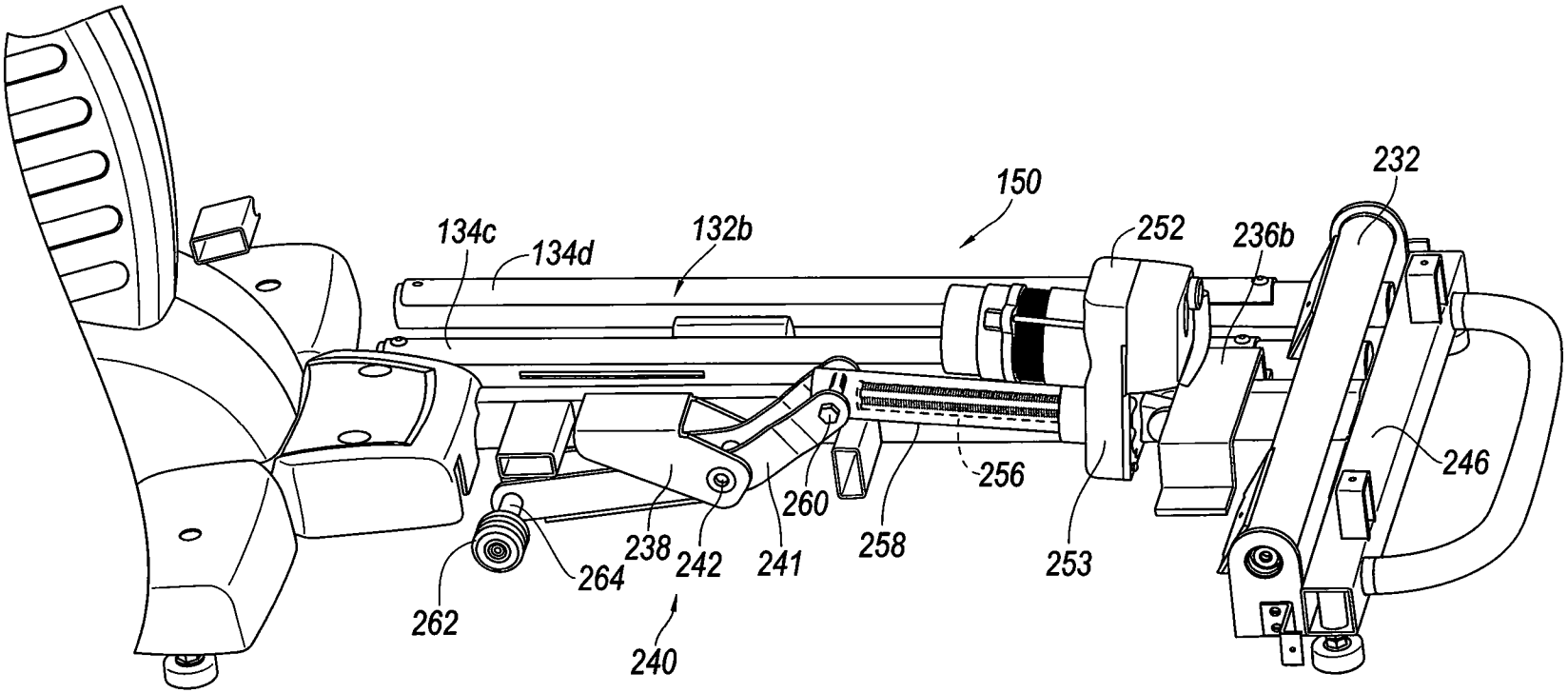
FIG. 2B is a similar isometric view of the incline adjustment system with additional components removed for clarity.
Figure 3:
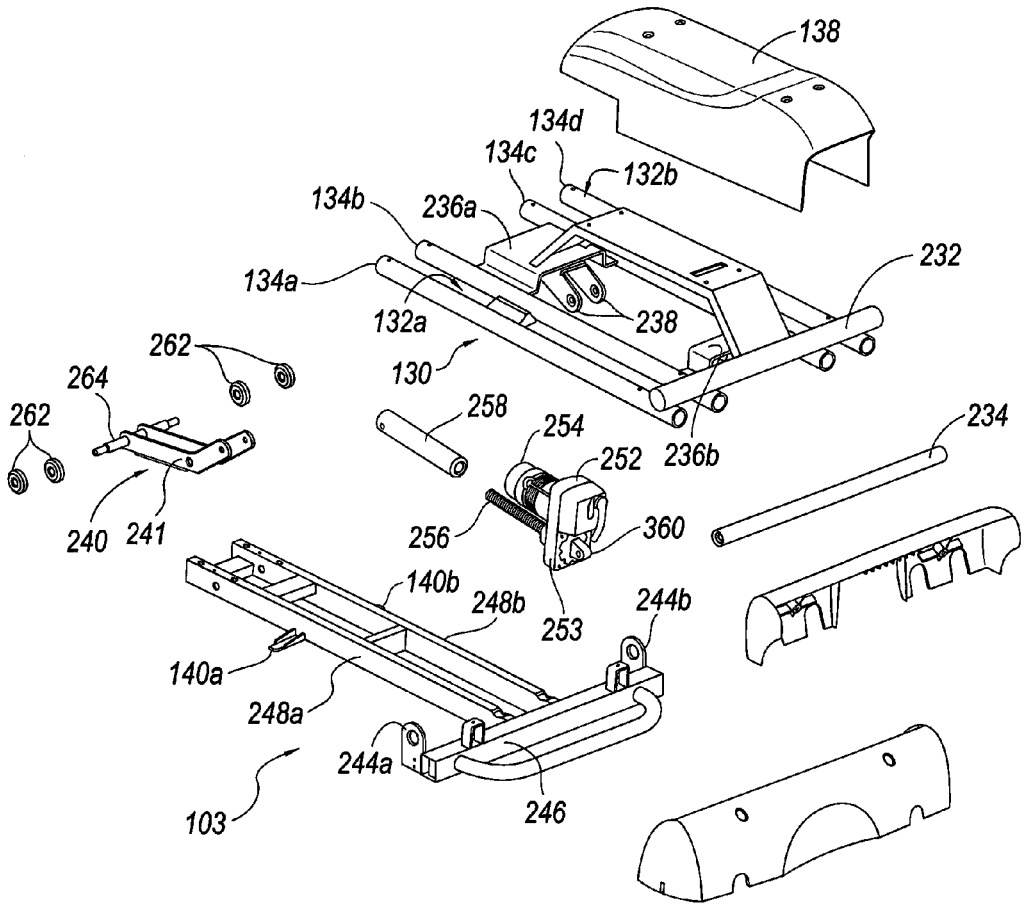
FIG. 3 is an exploded isometric view of a rear portion of the exercise machine of FIGS. 1A and 1B, illustrating various features of the incline adjustment system of FIGS. 1A-2B.

FIGS. 2A and 2B are enlarged isometric views of a rear portion of the exercise machine 100 of FIGS. 1A and 1B with a number of components removed for purposes of clarity. In FIG. 2A, for example, the rear cover 138 and the roller covers 129 have been omitted; and in FIG. 2B, the first guide track 132*a* has also been omitted. FIG. 3 is an exploded isometric view illustrating various components from the rear portion of the exercise machine 100. Referring to FIGS. 2A-3 together, the rear portion 103 of the base structure 102 includes a pair of longitudinal beams 248 (identified individually as a first beam 248*a* and a second beam 248*b*) which are fixedly attached to a rear cross member 246 and extend forward therefrom. An individual track support 140 extends outwardly from each of the beams 248.

In the illustrated embodiment, the track frame 130 includes a rear cross tube 232 pivotally attached to the rear portion 103 of the base structure 102 by means of a spindle 234. The spindle 234 extends through the cross tube 232 and is supported at opposite ends by brackets 244 (identified individually as a first bracket 244*a* and a second bracket 244*b*) which extend upwardly from opposite ends of the cross member 246. The rods 134 of the guide tracks 132 are fixedly attached to the rear cross tube 232 by weldments, fasteners, and/or other suitable features and extend forward therefrom. A forward support bracket 236*a* is fixedly attached to the first and second guide tracks 132 toward a front end portion of the track frame 130, and a rear support bracket 236*b* is fixedly attached to the guide tracks 132 toward a rear portion of the track frame 130.

In one aspect of the present disclosure, the incline adjustment system 150 includes a driver 252 operably coupled to a lift member 240. In the illustrated embodiment, the driver 252 includes an electric motor 254 operably coupled to a drive screw 256 by, e.g., a suitable gear set or transmission in a housing 253. The housing 253 is mounted to the rear support bracket 236*b* by means of a lug 360 (FIG. 3). The electric motor 254 can receive electrical power during operation from a facility outlet, battery, and/or other suitable power source. The drive screw 256 is threadably received in a corresponding socket or sleeve 258 having a series of female or internal threads which cooperate with the external threads on the drive screw 256. A distal end portion of the sleeve 258 is pivotally coupled to a proximal end portion of the lift member 240 by means of a pin 260. In the illustrated embodiment, the lift member 240 includes a lever 241 pivotally coupled to a fitting 238 (e.g., a double-sided clevis fitting) by a suitable shaft or pin 242. The fitting 238 is fixedly attached to the forward support bracket 236*a*. As shown to good effect in FIG. 2B, one or more rollers 262 can be rollably mounted on a shaft 264 fixed to a distal end portion of the lever 241. As described in greater detail below, the rollers 262 are configured to contact and press against the floor 10 to raise and lower the guide tracks 132 during operation of the incline adjustment system 150.

Figure 4A:
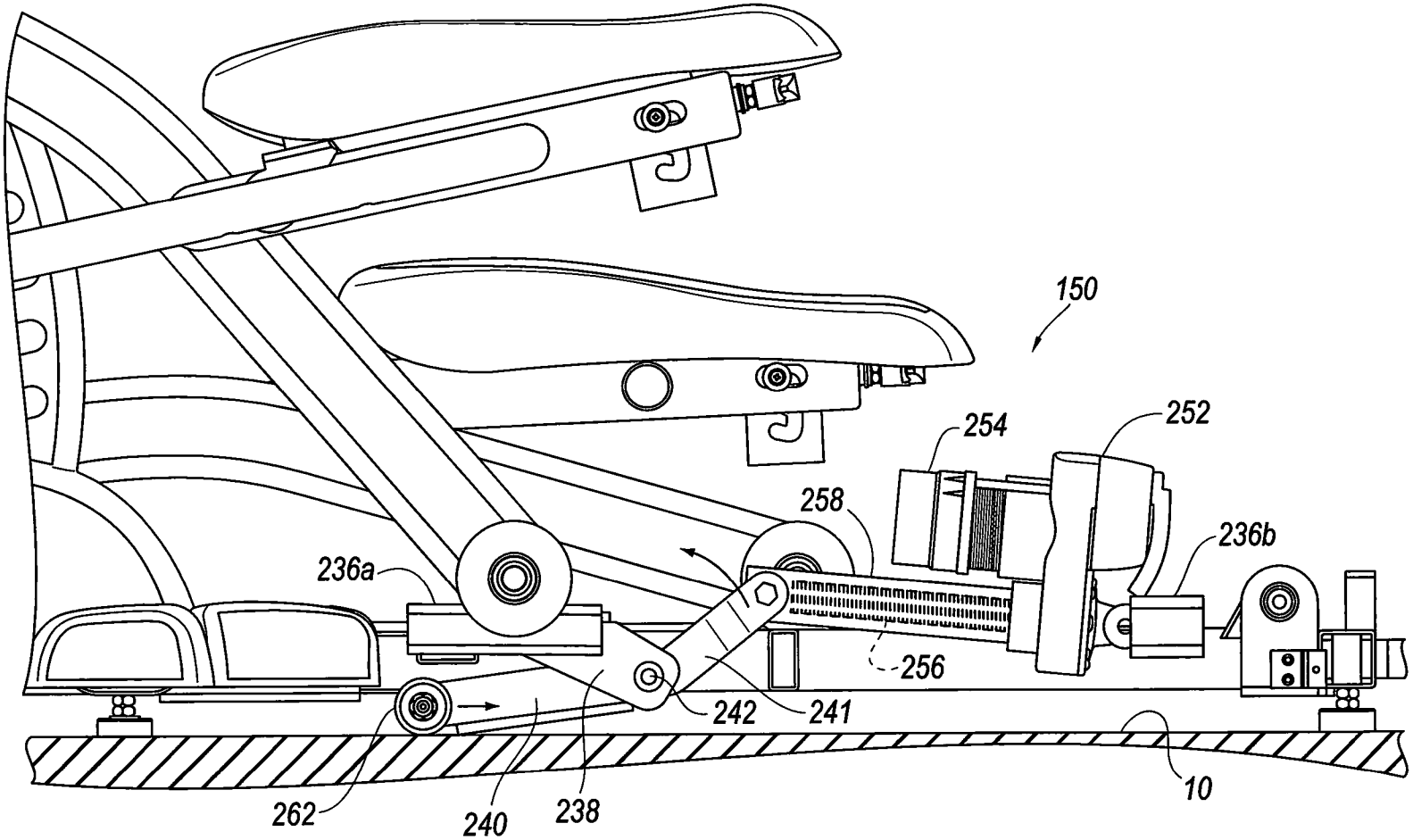
FIGS. 4A and 4B are enlarged side elevation views illustrating two stages of operation of the incline adjustment system of FIGS. 1A-3 in accordance with an embodiment of the disclosure.
Figure 4B:
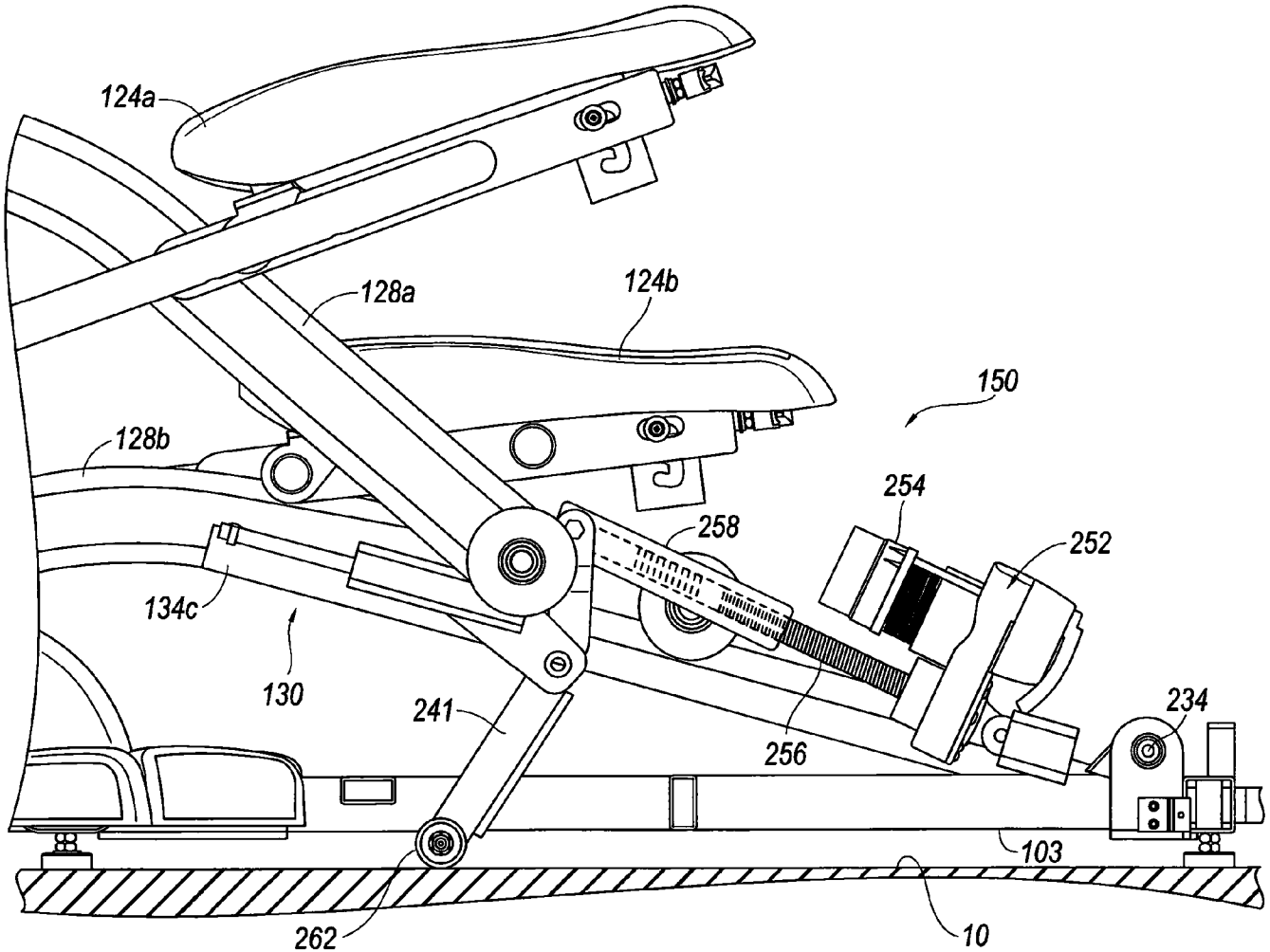

FIGS. 4A and 4B are enlarged side views illustrating the incline adjustment system 150 in a lowered or horizontal position and a raised or inclined position, respectively, in accordance with an embodiment of the disclosure. To operate the incline adjustment system 150 and raise the guide tracks 132, the user depresses or otherwise actuates the corresponding control on the control panel 106 (FIGS. 1A and 1B) to activate the electric motor 254. As the drive screw 256 rotates in a first direction about its longitudinal axis, it drives the threaded sleeve 258 outwardly against the proximal end portion of the lever 241. As the proximal end portion of the lever 241 moves away from the driver 252, the distal end portion of the lever 241 rotates downwardly and away from the guide tracks 132. This rotation causes the rollers 262 to press against and roll aft along the floor 10, which imparts vertical force on the pin 242 and causes the guide tracks 132 to incline. Continued rotation of the lever 241 increases the inclination of the guide tracks 132. When the guide tracks 132 reach a desired inclination, the user stops the electric motor 254 via the control panel 106 to hold the guide tracks 132 in the elevated position as shown in, for example, FIG. 4B. When the user wishes to reduce the inclination of the guide tracks 132, the user simply actuates the control in the opposite direction which, in turn, causes the electric motor 254 to rotate the drive screw 256 in the opposite direction about its longitudinal axis. This causes the sleeve 258 to retract back toward the drive screw 256 which, in turn, causes the distal end portion of the lever 241 to rotate upwardly and toward the guide tracks 132, thereby lowering the guide tracks 132 back toward, for example, the position shown in FIG. 4A.

Although the incline adjustment system 150 described above with reference to FIGS. 2A-4B includes an electric motor by way of example, incline adjustment systems configured in accordance with the present disclosure can include pneumatically, hydraulically, and/or manually operated systems without departing from the spirit or scope of the present disclosure. For example, in other embodiments incline adjustment systems configured in accordance with the present disclosure can include hand and/or foot operated systems that allow the user to manually rotate the lever 241 to a desired inclination. In further embodiments, an electrically or manually driven pneumatic system, or an electrically or manually driven hydraulic system, can be used to rotate the lever 241 and adjust the guide tracks 132 as desired. Such pneumatic and/or hydraulic systems can include a suitable piston/cylinder arrangement.

Moreover, although the incline adjustment system 150 described above includes a pivoting lift member (e.g., a lever) that contacts the floor, in other embodiments incline adjustment systems configured in accordance with the present disclosure can include other types of lift members that push directly against the floor to lift the guide tracks 132. Such lift members can include, for example, a manually, electrically, pneumatically, and/or hydraulically driven structure (e.g., a piston, ram, drive screw, etc.) that moves linearly (e.g., straight down) relative to the track frame 130 (FIG. 3) to push against the floor and raise the tracks 132 as desired. Accordingly, as those of ordinary skill in the art will appreciate, the various aspects of track adjustment systems disclosed herein are not limited to pivoting lift members and/or electric motor/drive screw systems, but are equally applicable and usable with other types of lift members using manual, hydraulic, pneumatic and/or other methods of operation.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

I claim:

1. An elliptical exercise machine for use on a floor, the elliptical exercise machine comprising:

a base structure;

a rotating member rotatably supported by a front portion of the base structure;

a first track pivotally coupled to a rear portion of the base structure;

a second track pivotally coupled to the rear portion of the base structure adjacent to the first track;

a first arm having a first arm front portion pivotally coupled to the rotating member and a first arm rear portion movably supported by the first track;

a second arm having a second arm front portion pivotally coupled to the rotating member and a second arm rear portion movably supported by the second track;

a first foot support operably coupled to the first arm;

a second foot support operably coupled to the second arm, wherein movement of the first and second foot supports drives the rotating member by means of the first and second arms as the first arm rear portion moves back and forth on the first track and the second arm rear portion moves back and forth on the second track; and a track adjustment system operably coupled to the first and second tracks, wherein the track adjustment system includes— a driver; and a lift member having a distal end portion configured to contact the floor and a proximal end portion operably coupled to the driver, wherein operation of the driver in a first direction moves the distal end portion of the lift member away from the first and second tracks and against the floor, thereby increasing the inclination of the first and second tracks relative to the floor, and wherein operation of the driver in a second direction opposite to the first direction moves the distal end portion of the lift member toward the first and second tracks, thereby reducing the inclination of the first and second tracks relative to the floor.

2. The elliptical exercise machine of claim 1 wherein the lift member is pivotally coupled to a frame that includes the first and second tracks, and wherein operation of the driver in the first direction rotates the distal end portion of the lift member away from the first and second tracks, and wherein operation of the driver in the second direction opposite to the first direction rotates the distal end portion of the lift member toward the first and second tracks.

3. The elliptical exercise machine of claim 1, further comprising a roller rotatably mounted on the distal end portion of the lift member, wherein operation of the driver in the first direction moves the roller across the floor in a first direction, and wherein operation of the driver in the second direction moves the roller across the floor in a second direction, opposite to the first direction.

4. The elliptical exercise machine of claim 1 wherein the driver includes an electric motor, wherein operation of the electric motor in a first mode moves the distal end portion of the lift member away from the first and second tracks, and wherein operation of the electric motor in a second mode moves the distal end portion of the lift member toward the first and second tracks.

5. The elliptical exercise machine of claim 1 wherein the lift member is pivotally coupled to a frame that includes the first and second tracks, wherein the driver includes an electric motor, and wherein operation of the electric motor in a first mode rotates the distal end portion of the lift member away from the first and second tracks, and wherein operation of the electric motor in a second mode rotates the distal end portion of the lift member toward the first and second tracks.

6. The elliptical exercise machine of claim 1 wherein the driver includes:

an electric motor;

a drive screw operably coupled to the electric motor; and a sleeve having a first end portion pivotally coupled to the proximal end portion of the lift member and a second end portion defining an opening that threadably receives the drive screw, wherein operation of the electric motor in a first mode rotates the drive screw in a first direction, thereby moving the sleeve away from the drive screw and driving the distal end portion of the lift member away from the first and second tracks and against the floor, and wherein operation of the electric motor in a second mode rotates the drive screw in a second direction opposite to the first direction, thereby moving the sleeve toward the drive screw and driving the distal end portion of the lift member toward the first and second tracks.

7. The elliptical exercise machine of claim 1:

wherein the first and second tracks are components of a frame pivotally coupled to the rear portion of the base structure;

wherein the lift member is pivotally mounted to the frame; and wherein the driver includes:

an electric motor coupled to the frame;

a drive screw operably coupled to the electric motor; and a sleeve having a first end portion pivotally coupled to the proximal end portion of the lift member and a second end portion defining an opening that threadably receives the drive screw, wherein operation of the electric motor in a first mode rotates the drive screw in a first direction, thereby moving the sleeve away from the drive screw and rotating the distal end portion of the lift member away from the first and second tracks, and wherein operation of the electric motor in a second mode rotates the drive screw in a second direction opposite to the first direction, thereby moving the sleeve toward the drive screw and rotating the distal end portion of the lift member toward the first and second tracks.

8. The elliptical exercise machine of claim 1 wherein the driver is hydraulically operated.

9. The elliptical exercise machine of claim 1 wherein the driver is pneumatically operated.

10. The elliptical exercise machine of claim 1 wherein the driver is manually operated.

11. An elliptical exercise machine for use on a floor, the elliptical exercise machine comprising:

a base structure configured to support the elliptical exercise machine on the floor;

a wheel rotatably supported by a front portion of the base structure;

a track frame pivotally coupled to a rear portion of the base structure, wherein the track frame includes— a first track positioned toward a first side of the base structure; and a second track positioned toward a second side of the base structure adjacent to the first track;

a first arm positioned toward the first side of the base structure, the first arm having a first arm front portion pivotally coupled to the wheel and a first arm rear portion movably supported by the first track;

a second arm positioned toward the second side of the base structure, the second arm having a second arm front portion pivotally coupled to the rotating member and a second arm rear portion movably supported by the second track;

a first foot support operably coupled to the first arm between the first arm front portion and the first arm rear portion;

a second foot support operably coupled to the second arm between the second arm front portion and the second arm rear portion, wherein movement of the first and second foot supports rotates the wheel by means of the first and second arms as the first arm rear portion reciprocates on the first track and the second arm rear portion reciprocates on the second track;

a lever pivotally coupled to the track frame; and a driver operably coupled to a proximal end portion of the lever, wherein operation of the driver in a first direction causes a distal end portion of the lever to rotate away from the track frame and press downwardly against the floor, thereby elevating a front end portion of the first and second tracks relative to a rear end portion of the first and second tracks, and wherein operation of the driver in a second direction opposite to the first direction causes the distal end portion of the lever to rotate back toward the track frame, thereby reducing the elevation of the front end portion of the first and second tracks relative to the rear end portion of the first and second tracks.

12. The elliptical exercise machine of claim 11, further comprising:

a first handle pivotally supported by the base structure between a first handle upper portion and a first handle lower portion, wherein the first handle upper portion includes a first hand grip portion;

a second handle pivotally supported by the base structure between a second handle upper portion and a second handle lower portion, wherein the second handle upper portion includes a second hand grip portion;

a first foot support link having a first support link rear portion operably coupled to the first foot support and a first support link front portion pivotally coupled to the first handle lower portion; and a second foot support link having a second support link rear portion operably coupled to the second foot support and a second support link front portion pivotally coupled to the second handle lower portion.

* * * * *